US009840681B2

(12) United States Patent
Holder et al.

(10) Patent No.: US 9,840,681 B2
(45) Date of Patent: Dec. 12, 2017

(54) CONCENTRATED SURFACTANT COMPOSITION

(71) Applicant: The Procter & Gamble Company, Cincinnati, OH (US)

(72) Inventors: James William Holder, Fort Thomas, KY (US); Gayle Marie Frankenbach, Cincinnati, OH (US); Stephen Joseph Hodson, Franklin, OH (US); Diederik Emiel Omer Vanhoutte, Deinze (BE); Gregory Thomas Waning, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/284,420

(22) Filed: May 22, 2014

(65) Prior Publication Data

US 2014/0349914 A1 Nov. 27, 2014

Related U.S. Application Data

(60) Provisional application No. 61/827,155, filed on May 24, 2013.

(51) Int. Cl.

| | |
|---|---|
| ***C11D 1/12*** | (2006.01) |
| ***C11D 1/14*** | (2006.01) |
| ***C11D 1/29*** | (2006.01) |
| ***C11D 3/20*** | (2006.01) |
| ***C11D 11/00*** | (2006.01) |

(52) U.S. Cl.

CPC ..... *C11D 1/12* (2013.01); *C11D 1/146* (2013.01); *C11D 1/29* (2013.01); *C11D 3/2075* (2013.01); *C11D 3/2086* (2013.01); *C11D 11/0094* (2013.01)

(58) Field of Classification Search

None

See application file for complete search history.

(56) References Cited

U.S. PATENT DOCUMENTS

| | | | |
|---|---|---|---|
| 2,493,445 | A | 1/1950 | Randolph et al. |
| 3,600,318 | A | 8/1971 | Mast |
| 3,650,968 | A | 3/1972 | Hodge et al. |
| 4,242,215 | A | 12/1980 | Aalbers et al. |
| 4,285,841 | A | 8/1981 | Barrat et al. |
| 4,486,195 | A | 12/1984 | Lillis et al. |
| 4,529,525 | A | 7/1985 | Dormal et al. |
| 4,737,314 | A | 4/1988 | Yokoyama et al. |
| 5,057,246 | A | 10/1991 | Bertho et al. |
| 5,466,851 | A | 11/1995 | Adams et al. |
| 5,484,555 | A | 1/1996 | Schepers |
| 5,536,438 | A | 7/1996 | Scialla et al. |
| 5,559,090 | A | 9/1996 | Scialla et al. |
| 5,565,145 | A | 10/1996 | Watson et al. |
| 5,641,739 | A | 6/1997 | Kott et al. |
| 5,759,989 | A | 6/1998 | Bianchetti et al. |
| 5,858,948 | A | 1/1999 | Ghosh et al. |
| 5,972,869 | A | 10/1999 | Cao et al. |
| 6,037,317 | A | 3/2000 | Rapisarda et al. |
| 6,054,424 | A | 4/2000 | Ip |
| 6,060,443 | A | 5/2000 | Cripe et al. |
| 6,066,610 | A | 5/2000 | Sramek |
| 6,159,925 | A | 12/2000 | Blandiaux |
| 6,176,277 | B1 | 1/2001 | Mayer |
| 6,183,757 | B1 | 2/2001 | Beerse et al. |
| 6,239,092 | B1 | 5/2001 | Papasso et al. |
| 6,251,844 | B1 | 6/2001 | Leonard et al. |
| 6,262,007 | B1 | 7/2001 | Scialla et al. |
| 6,303,556 | B1 | 10/2001 | Kott et al. |
| 6,313,085 | B1 | 11/2001 | Le Hen-Ferrenbach |
| 6,376,449 | B2 | 4/2002 | Olsen |
| 6,451,064 | B1 | 9/2002 | Del Duca et al. |
| 6,521,577 | B1 | 2/2003 | Ofosu-Asante et al. |
| 6,525,012 | B2 | 2/2003 | Price et al. |
| 6,627,590 | B1 | 9/2003 | Sherry et al. |
| 6,630,435 | B1 | 10/2003 | Gagliardini et al. |
| 6,740,630 | B2 | 5/2004 | Aouad et al. |
| 6,797,685 | B2 | 9/2004 | Zhu et al. |
| 7,148,187 | B1 * | 12/2006 | Simon et al. ..... 510/235 |
| 7,820,610 | B2 | 10/2010 | Showell et al. |
| 8,026,203 | B2 | 9/2011 | Courchay et al. |
| 8,097,579 | B2 | 1/2012 | Danzinger et al. |
| 8,729,007 | B2 | 5/2014 | Sadlowski et al. |
| 2002/0107167 | A1 | 8/2002 | Aizawa et al. |
| 2003/0185783 | A1 | 10/2003 | Terazaki |
| 2004/0092413 | A1 | 5/2004 | Ticktin |
| 2004/0092422 | A1 | 5/2004 | Carr et al. |
| 2006/0040837 | A1 | 2/2006 | Frantz et al. |
| 2006/0111261 | A1 | 5/2006 | Sadlowski et al. |
| 2006/0251605 | A1 | 11/2006 | Belmar et al. |
| 2008/0015135 | A1 | 1/2008 | De Buzzaccarini et al. |
| 2008/0139434 | A1 | 6/2008 | Basappa et al. |
| 2008/0248988 | A1 | 10/2008 | Gambogi et al. |
| 2009/0215854 | A1 | 8/2009 | Pan et al. |
| 2009/0312227 | A1 | 12/2009 | Murphy et al. |

(Continued)

FOREIGN PATENT DOCUMENTS

| | | | |
|---|---|---|---|
| BE | 1010942 | A6 | 3/1999 |
| DE | 19822688 | A1 | 11/1999 |

(Continued)

OTHER PUBLICATIONS

PCT Search Report; PCT/US2014/039099; dated Sep. 5, 2014; 11 Pages.

J. Chem. Soc., Faraday Trans. I, 1983, 79, 953-964; "Kinetics of the Acid-catalysed Hydrolysis of Dodecylsulphate and Dodecyldiethoxysulphate Surfactants in Concentrated Micellar Solutions"; Christopher J. Garnet.

J. Chem. Soc., Perkin Trans. 2, 2001, 1489-1495; "The hydrolysis of C12 primary alkyl sulfates in concentratedaqueous solutions. Part 1. General features, kinetic form and mode of catalysis in sodium dodecyl sulfate hydrolysis" ; Donald Bethell.

PCT Search Report dated Sep. 5, 2014; 11 Pages; PCT/US2014/039099.

*Primary Examiner* — Necholus Ogden, Jr.

(74) *Attorney, Agent, or Firm* — Gregory S. Darley-Emerson; Leonard W. Lewis; Steven W. Miller

(57) ABSTRACT

Concentrated surfactant compositions, and more specifically, concentrated low pH compositions comprising sulfated surfactants. Methods of making and using the same.

10 Claims, No Drawings

(56) References Cited

U.S. PATENT DOCUMENTS

| | | | |
|---|---|---|---|
| 2010/0093595 | A1 | 4/2010 | Holzhauer et al. |
| 2010/0303739 | A1 | 12/2010 | Spoerer et al. |
| 2011/0061174 | A1 | 3/2011 | Boutique et al. |
| 2011/0075466 | A1 | 3/2011 | Thorp et al. |
| 2011/0146707 | A1 | 6/2011 | Cermenati et al. |
| 2011/0146725 | A1 | 6/2011 | Woo et al. |
| 2013/0061402 | A1 | 3/2013 | Frankenbach et al. |
| 2013/0184195 | A1 | 7/2013 | Sadlowski et al. |
| 2013/0267451 | A1 | 10/2013 | Hardy et al. |
| 2013/0281344 | A1 | 10/2013 | Tarng et al. |
| 2013/0305461 | A1 | 11/2013 | Ceccobelli et al. |
| 2014/0026331 | A1 | 1/2014 | Boeh et al. |

FOREIGN PATENT DOCUMENTS

| | | | |
|---|---|---|---|
| DE | 100 32 588 | A1 | 1/2002 |
| EP | 0019315 | A1 | 11/1980 |
| EP | 0518401 | A1 | 12/1992 |
| EP | 0619366 | A1 | 10/1994 |
| EP | 0666308 | A2 | 8/1995 |
| EP | 0781 836 | A1 | 7/1997 |
| EP | 0839903 | A1 | 5/1998 |
| EP | 0908511 | A1 | 4/1999 |
| EP | 1696023 | A1 | 8/2006 |
| EP | 2522714 | A1 | 11/2012 |
| GB | 1489694 | A | 10/1977 |
| GB | 2205578 | A | 12/1988 |
| GB | 1489694 | A | 10/1997 |
| JP | 2000192092 | A | 7/2000 |
| JP | 2002053894 | A | 2/2002 |
| JP | 2007308592 | A | 11/2007 |
| JP | 2012092163 | A | 5/2012 |
| WO | WO 91/16409 | A1 | 10/1991 |
| WO | WO 94/01520 | A1 | 1/1994 |
| WO | WO 98/27189 | A1 | 6/1998 |
| WO | WO 99/09944 | A1 | 3/1999 |
| WO | WO 99/10457 | A1 | 3/1999 |
| WO | WO 00/71667 | A1 | 11/2000 |
| WO | WO 01/05874 | A1 | 1/2001 |
| WO | WO 02/50225 | A1 | 6/2002 |
| WO | WO 01/00758 | A2 | 1/2004 |
| WO | WO 2006/055788 | A1 | 5/2006 |
| WO | WO 2007/107191 | A1 | 9/2007 |
| WO | WO 2007/111888 | A1 | 10/2007 |
| WO | WO 2008/068222 | A1 | 6/2008 |
| WO | WO 2009/148914 | A1 | 12/2009 |
| WO | WO 2009/154614 | A1 | 12/2009 |
| WO | WO 2010/034736 | A1 | 4/2010 |
| WO | WO 2011/027721 | A1 | 3/2011 |
| WO | WO 2011/032138 | A2 | 3/2011 |
| WO | WO 2012/122232 | A1 | 9/2012 |
| WO | WO 2013/041832 | A1 | 3/2013 |
| WO | WO 2013/092049 | A1 | 6/2013 |
| WO | WO 2013/142486 | A1 | 9/2013 |
| WO | WO 2014/018309 | A1 | 1/2014 |

* cited by examiner

CONCENTRATED SURFACTANT COMPOSITION

FIELD OF THE INVENTION

The present disclosure relates to concentrated surfactant compositions, and more specifically, to concentrated low pH compositions comprising sulfated surfactants. The present disclosure also relates to methods of making and using the same.

BACKGROUND OF THE INVENTION

Concentrated surfactant compositions are desirable for a number of reasons. Concentrated surfactant compositions can be used neat, or they may be used to formulate other compositions, such as liquid laundry detergents. Concentrated compositions, with high levels of active ingredients, give the formulator flexibility. Lower levels of water can lead to lower transportation costs. Concentrated formulas may be useful in unitized dose compositions. Concentrated compositions may have a smaller ecological footprint as they use less packaging. However, concentrated compositions can lead to viscosity and stability challenges. For example, concentrated surfactant compositions may be too "thick" and lead to difficulties in processing or usage. Furthermore, at high concentrations, the composition may phase separate, or some surfactants may salt out. Therefore, there is a continuing need for improved concentrated surfactant compositions with good stability and desirable viscosity.

It is known that sulfated surfactants such as alkyl ethoxylated surfactants may be formulated at increased concentrations (e.g., 75% active or more) at somewhat acidic pHs (e.g., pH 5.5). The use of fatty acids has been taught to lower the pH and help to solubilize the sulfated surfactants. However, such compositions may remain relatively "thick" (e.g., viscosities of about 40 Pa*s at 1 $s^{-1}$ or more) and can be challenging to transport, handle, or process. Furthermore, concentrated sulfated surfactant compositions can be chemically unstable at low pHs.

A need therefore exists for a stable concentrated surfactant composition that comprises an increased concentration of sulfated surfactant with desirable viscosity. The present disclosure meets this need by providing, in part, a stable, low pH, concentrated surfactant composition comprising sulfated surfactant and organic acid.

SUMMARY OF THE INVENTION

The present disclosure provides a concentrated surfactant composition comprising: at least about 50% substantially neutralized sulfated surfactant; and from about 5% to about 30% of a water-soluble organic acid; where the composition has a pH of from about 2 to about 6.9 when measured in an aqueous 10% solution of the composition.

The present disclosure also provides a concentrated surfactant composition comprising: at least about 50% substantially neutralized sulfated surfactant selected from alkyl sulfate, alkyl ethoxylated sulfate, or mixtures thereof; from about 5% to about 30% of lactic acid; and from about 15% to about 25% water; where the composition has a pH of from about 3 to about 5 when measured in an aqueous 10% solution of the composition.

The present disclosure also provides a detergent composition comprising a concentrated surfactant composition, where the concentrated surfactant composition comprises a sulfated surfactant, an organic acid, and a laundry adjunct.

The present disclosure also provides a method for preparing a detergent composition comprising the steps of providing a concentrated surfactant composition as described in this disclosure; and mixing the concentrated surfactant composition with water, laundry adjuncts, or mixtures thereof to form a detergent composition.

DETAILED DESCRIPTION OF THE INVENTION

As used herein, the articles "a" and "an" when used in a claim, are understood to mean one or more of what is claimed or described.

As used herein, the terms "include," "includes," and "including" are meant to be non-limiting.

As used herein, the term "comprising" means various components conjointly employed in the preparation of the composition or methods of the present disclosure. Accordingly, the terms "consisting essentially of" and "consisting of" are embodied in the term "comprising".

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included.

Unless otherwise noted, all component or composition levels are in reference to the active portion of that component or composition, and are exclusive of impurities, for example, residual solvents or by-products, which may be present in commercially available sources of such components or compositions. By weight according to the present disclosure shall means % by weight. Unless indicated otherwise, all percentages are % by weight of the concentrated surfactant composition.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Concentrated Surfactant Composition

The present disclosure relates to a stable concentrated surfactant composition that comprises an increased concentration of sulfated surfactant. More specifically, the present disclosure provides a low pH, concentrated surfactant composition comprising sulfated surfactant and organic acid, which is, in some aspects, physically and/or chemically stable.

Sulfated Surfactant

The concentrated surfactant composition of the present invention comprises sulfated surfactant. In some aspects, the sulfated surfactant is selected from alkyl sulfate, alkyl alkoxylated sulfate, or mixtures thereof. In some aspects, the sulfated surfactant is selected from C10 to 22 alkyl sulfate (AS), C10 to 22 alkyl alkoxy sulfate, or mixtures thereof. The sulfated surfactant may be linear, branched, or mixtures thereof; branched sulfated surfactants are described below.

The sulfated surfactant may be sourced from either natural or petrochemical-derived feedstocks. As used herein, "natural" feedstocks means feedstocks either biologically derived or non-geologically derived.

In some aspects of the present invention, the sulfated surfactant is an alkyl alkoxy sulfate. The alkyl alkoxy sulfate may comprise ethoxy groups, propoxy groups, or mixtures thereof. In some aspects, the alkyl alkoxy sulfate is an alkyl ethoxy sulfate (AES). In some aspects, the concentrated surfactant composition comprises an alkyl polyethoxylate sulfate, where the alkyl group contains from about 10 to about 22, typically from about 12 to about 18 carbon atoms, and where the polyethoxylate chain contains from about 1 to about 15, or more typically from about 1 to about 6, or even more typically from about 1 to about 4 ethoxylate moieties.

Alkyl ethoxy sulfate is particularly beneficial because of its whiteness cleaning performance and high efficiency. Such efficiency means that the composition requires less surfactant to achieve the same benefit, as compared to the traditional alkyl benzene sulphonate/nonionic surfactant system. Thus, by utilizing AES, either whiteness performance may be improved or the formulation may be compacted without any loss in performance. AES is further beneficial because its efficiency is such that equal performance may be achieved in cold water wash conditions.

The sulfated surfactants of the present invention may exist in an acid form, and the acid form may be neutralized to form a surfactant salt. The salt form is desirable for use in detergent compositions.

The neutralizing agent may be any suitable alkaline substance and may be added in excess of the amount required to neutralize the surfactant. The neutralizing agent may be selected from alkaline metal, alkaline earth metal, or substituted ammonium hydroxide, carbonate, bicarbonate, silicate, or mixtures thereof. In some aspects, the neutralizing agent is an alkaline metal, alkaline earth metal, or substituted ammonium hydroxide. In some aspects, the neutralizing agent is sodium hydroxide, potassium hydroxide, or mixtures thereof. In some aspects, the neutralizing agent is sodium hydroxide. The neutralizing agent may also be an amine or amide, for example, an alkanolamine. In some aspects, the neutralizing agent is an alkanolamine selected from monoethanolamine (MEA), diethanolamine, triethanolamine (TEA), 2-aminopropanol, monoisopropanol amine (MIPA), or mixtures thereof. In some aspects, however, the compositions are substantially free of alkanolamines.

Generally, the sulfated surfactant is substantially neutralized. By "substantially neutralized" it is meant that the sulfated surfactant is about 98% to about 100% neutralized. Sulfated surfactant that is less than 98% neutralized is generally unstable.

In some aspects, the concentrated surfactant composition comprises at least about 50%, or at least about 55%, or at least about 60%, by weight of the concentrated composition, sulfated surfactant. In some aspects, the concentrated surfactant composition comprises from about 50%, or from about 55%, or from about 60% and to about 65%, or to about 70%, or to about 75%, or to about 80%, by weight of the concentrated composition, of sulfated surfactant. In some aspects, the concentrated composition comprises from about 50% to about 75%, or from about 50% to about 70%, or from about 50% to about 65%, by weight of the composition, of a sulfated surfactant.

Compositions containing sulfated surfactant are known to be difficult to process when the sulfated surfactant is present at an increased concentration, e.g., greater than 50% by weight. For example, such increased concentrations of sulfated surfactant tend to increase the viscosity of the surfactant composition.

Organic Acid

According to the present invention, organic acid may be used as a solvent to manage the viscosity of the sulfated surfactant concentrate. The concentrated surfactant composition of the present invention comprises an organic acid, which, in some aspects, is a water-soluble organic acid. In some aspects, the concentrated composition comprises from about 5% to about 30%, by weight of the concentrated composition, of the organic acid. In some aspects, the concentrated composition comprises from about 10% to about 25%, or from about 12% to about 22%, by weight of the concentrated composition, of the organic acid.

The organic acid is present in the composition in its free acid form and in its salt form, forming a molar ratio. As used herein, the "salt" of an acid includes the acid's anionic conjugate base and salts thereof. For example, as used herein, the salt of lactic acid includes lactate ion and, e.g., sodium lactate. In some aspects, from about 5% to about 95% of the total organic acid is present in its free acid form. In some aspects, the molar ratio of the free acid form to salt is from about 95:5 to about 5:95,or from about 5:1 to about 1:5, or from about 3:1 to about 1:3, or from about 2:1 to about 1:2. This ratio may be regulated by the amount of neutralizing agent added to the composition.

It is believed that in its acid form, the organic acid functions as a solvent and reduces the the viscosity of the concentrate. At lower pHs, e.g., pH of about 2 to about 6.9, more organic acid is present in its free acid form, thereby increasing the level of functional solvent and reducing the viscosity of the concentrated surfactant solution.

Additionally, it is believed that the organic acid provides chemical stability benefits to compositions of the present invention. Typically, sulfated surfactants are not stable in acidic conditions, tending to hydrolyze and revert over time to the constituent elements (typically, sulfate and alkyl (alkoxy) alcohols). This reversion process is further accelerated by acidic conditions. The reversion process, therefore, tends to be auto-catalytic as one of the reversion products, sulfuric acid, further stimulates the reversion reaction, resulting in faster reversion of the surfactant. However, it is believed that the presence of organic acid stabilizes the sulfated surfactant at low pHs, with the salt form of the organic acid acting as a proton sink. Methods to measure surfactant stability are known in the art. According to the present disclosure, sulfated surfactant stability is measured as a change in parts per million (ppm) of sulfate after storage, further described below.

The percentage of free organic acid and organic acid salt may be readily obtained using the well-known Henderson-Hasselbalch equation:

$$pH=pKa+\log_{10}([conjugate]/[acid]).$$

Standard pKa values are readily available in the art.

In some aspects, the organic acid is an organic carboxylic acid or a polycarboxylic acid. In some aspects, the organic acid is selected from acetic, adipic, aspartic, carboxymethyloxymalonic, carboxymethyloxysuccinic, citric, formic, glutaric, glycolic, hydroxyethyliminodiacetic, iminodiacetic, itaconic, lactic, maleic, malic, malonic, oxydiacetic, oxydisuccinic, succinic, sulfamic, tartaric, tartaric-disuccinic, and tartaric-monosuccinic acids, or mixtures thereof. In some aspects, the organic acid is selected from the group acetic acid, citric acid, formic acid, lactic acid, or mixtures thereof. In some aspects, the organic acid is selected from citric acid, lactic acid, or mixtures thereof.

In some aspects, the organic acid has a molecular weight of no more than about 210, or no more than about 100. In some aspects, the organic acid comprises 6 carbon atoms or fewer, or 4 carbon atoms or fewer, or 3 carbon atoms or fewer. In some aspects, the organic acid has a pKa greater than about 3.0, or alternatively, no pKa below about 3.0. In some aspects, the organic acid has a pKa of less than about 5, or less than about 4. In some aspects, the organic acid has a melt point of less than about 65° C. In some aspects, the organic acid is presented in an aqueous solution comprising at least about 75% organic acid, or at least about 85%, by weight of the aqueous solution, organic acid.

In some aspects of the present inventions, lactic acid may be favored over other organic acids, such as citric acid. For example, lactic acid can be provided in a high active form, for example in aqueous solutions comprising more than about 75%, or more than 85%, or about 88% or more, by weight of the aqueous solution, lactic acid. The high solubility of some organic acids reduces the need for processing aids, such as water or solvent that may not improve the performance of the final composition. Furthermore, lactic acid is soluble in water and can be used to produce low viscosity compositions. Additionally, it is believed that lactic acid can act as a solvent for other ingredients. Therefore, in some aspects of the present invention, the organic acid is lactic acid.

The organic acid may be a water-soluble organic acid. In some aspects, the organic acid has a solubility in water at 20° C. of at least about 10 g acid/100 ml water, or at least about 30 g acid/100 ml water, or at least about 50 g acid/100 ml water, or at least about 70 g acid/100 ml water, or at least about 85 g/100 ml water. In some aspects, the composition is substantially free of fatty acids.

pH

The concentrated compositions of the present disclosure are acidic and have a pH below 7 when measured in an aqueous 10% solution of the composition at 20±2° C. In some aspects, the pH of the composition is from about 2 to about 6.9, or from about 2 to about 6, or from about 3 to about 5, or from about 3.50 to about 4.25. As discussed above, in some aspects, a neutralizing agent such as sodium hydroxide, MEA, or any other neutralizing agent listed herein is added to the concentrated composition at a level to obtain the desired pH.

Unless otherwise stated herein, the pH of the composition is defined as the pH of an aqueous 10% (weight/volume) solution of the composition at 20±2° C. Any meter capable of measuring pH to ±0.01 pH units is suitable. Orion meters (Thermo Scientific, Clintinpark-Keppekouter, Ninovesteenweg 198, 9320 Erembodegem-Aalst, Belgium) or equivalent are acceptable instruments. The pH meter should be equipped with a suitable glass electrode with calomel or silver/silver chloride reference. An example includes Mettler DB 115. The electrode should be stored in the manufacturer's recommended electrolyte solution.

The 10% aqueous solution of the detergent is prepared according to the following procedure. A sample of 10±0.05 grams is weighted with a balance capable of accurately measuring to ±0.02 grams. The sample is transferred to a 100 mL volumetric flask, diluted to volume with purified water (deionized and/or distilled water are suitable as long as the conductivity of the water is <5 μS/cm), and thoroughly mixed. About 50 mL of the resulting solution is poured into a beaker, the temperature is adjusted to 20±2° C. and the pH is measured according to the standard procedure of the pH meter manufacturer. The manufacturer's instructions should be followed to set up and calibrate the pH assembly.

In some aspects, the concentrated compositions have a reserve alkalinity. As used herein, the term "reserve alkalinity" is a measure of the buffering capacity of the concentrated composition (units: equivalent grams NaOH/100 g concentrated composition) determined by titrating a 1% (w/v) solution of detergent composition with hydrochloric acid to pH 3.0 at 21° C. An appropriately selected reserve alkalinity can help to inhibit the autocatalytic nature of the hydrolysis of sulfated surfactants by preventing or inhibiting drops in pH. Reserve alkalinity can be achieved by selection of appropriate buffering agents; in the present invention, the organic acid may act as a buffering agent. In some aspects, the reserve alkalinity is from about 0.5 to about 7.5, or from about 0.75 to about 5.0, or from about 1.0 to about 4.0 equivalent grams NaOH/100 grams concentrated composition.

Water

In some aspects, the concentrated compositions of the present disclosure comprise limited amounts of water. In some aspects, the concentrated compositions comprise less than about 50%, or about 30%, or less than about 20%, or less than about 10% by weight of the concentrated composition water. In some aspects, the concentrated compositions comprise from about 5% to about 50%, or from about 10% to about 45%, or from about 12% to about 25%, or from about 15% to about 20% by weight of the concentrated composition water. In some aspects, the concentrated compositions comprise from about 1% to about 30%, or from about 5% to about 20% by weight of the composition water. In some aspects, the compositions are substantially free of water, or comprise no freely added (or neat) water. In some aspects, water enters the composition as a component of other ingredients, for example, as a carrier of sodium hydroxide or organic acid. It is understood that water may also be formed from the neutralization of acids in the composition, for example, from acid-form alkyl ethoxylated sulfate (HAES) or lactic acid. Such water is not understood herein to be freely added water.

Optional Concentrated Composition Ingredients

The concentrated compositions may optionally comprise additional ingredients, for example, branched surfactants, nonionic surfactant, organic solvent, hydrotrope, polymers, or mixtures thereof.

Branched Surfactants

Suitable branched detersive surfactants include anionic branched surfactants selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups. Although branched surfactants are listed here as "optional" ingredients, it is understood that the concentrated compositions of the present application may comprise, consist of, or essentially consist of branched sulphate surfactants.

In some aspects, the branched detersive surfactant is a mid-chain branched detersive surfactant, typically, a mid-chain branched anionic detersive surfactant, for example, a mid-chain branched alkyl sulphate and/or a mid-chain branched alkyl benzene sulphonate. In some aspects, the detersive surfactant is a mid-chain branched alkyl sulphate. In some aspects, the mid-chain branches are $C_{1-4}$ alkyl groups, typically methyl and/or ethyl groups.

In some aspects, the branched surfactant comprises a longer alkyl chain, mid-chain branched surfactant compound of the formula:

$$A_b—X—B$$

where:

(a) $A_b$ is a hydrophobic C9 to C22 (total carbons in the moiety), typically from about C12 to about C18, mid-chain branched alkyl moiety having: (1) a longest linear carbon chain attached to the —X—B moiety in the range of from 8 to 21 carbon atoms; (2) one or more C1-C3 alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—B moiety) to position ω-2 carbon (the terminal carbon minus 2 carbons, i.e., the third carbon from the end of the longest linear carbon chain); and (4) the surfactant composition has an average total number of carbon atoms in the $A_b$-X moiety in the above formula within the range of greater than 14.5 to about 17.5 (typically from about 15 to about 17);

b) B is a hydrophilic moiety selected from sulfates, sulfonates, amine oxides, polyoxyalkylene (such as polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkylated/polyhydroxyalkylated quats, alkylated/polyhydroxylated oxypropyl quats, imidazolines, 2-yl-succinates, sulfonated alkyl esters, and sulfonated fatty acids (it is to be noted that more than one hydrophobic moiety may be attached to B, for example as in $(A_b\text{-}X)_z$—B to give dimethyl quats); and (c) X is selected from —CH2- and —C(O)—.

Generally, in the above formula the $A_b$ moiety does not have any quaternary substituted carbon atoms (i.e., 4 carbon atoms directly attached to one carbon atom). Depending on which hydrophilic moiety (B) is selected, the resultant surfactant may be anionic, nonionic, cationic, zwitterionic, amphoteric, or ampholytic. In some aspects, B is sulfate and the resultant surfactant is anionic.

In some aspects, the branched surfactant comprises a longer alkyl chain, mid-chain branched surfactant compound of the above formula wherein the $A_b$ moiety is a branched primary alkyl moiety having the formula:

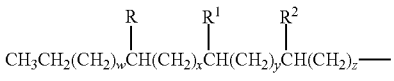

wherein the total number of carbon atoms in the branched primary alkyl moiety of this formula (including the R, $R^1$, and $R^2$ branching) is from 13 to 19; R, R1, and R2 are each independently selected from hydrogen and C1-C3 alkyl (typically methyl), provided R, R1, and R2 are not all hydrogen and, when z is 0, at least R or R1 is not hydrogen; w is an integer from 0 to 13; x is an integer from 0 to 13; y is an integer from 0 to 13; z is an integer from 0 to 13; and w+x+y+z is from 7 to 13.

In certain aspects, the branched surfactant comprises a longer alkyl chain, mid-chain branched surfactant compound of the above formula wherein the $A_b$ moiety is a branched primary alkyl moiety having the formula selected from:

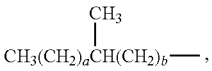

(I)

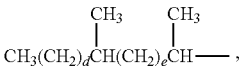

(II)

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

In the mid-chain branched surfactant compounds described above, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for monomethyl branched alkyl $A^b$ moieties.

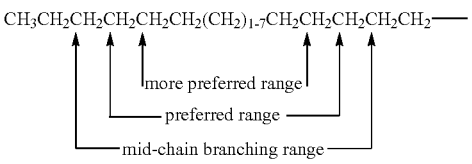

For mono-methyl substituted surfactants, these ranges exclude the two terminal carbon atoms of the chain and the carbon atom immediately adjacent to the —X—B group.

The formula below illustrates the mid-chain branching range, preferred mid-chain branching range, and more preferred mid-chain branching range for di-methyl substituted alkyl $A^b$ moieties.

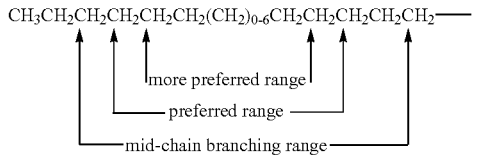

Additional suitable branched surfactants are disclosed in U.S. Pat. Nos. 6,008,181, 6,060,443, 6,020,303, 6,153,577, 6,093,856, 6,015,781, 6,133,222, 6,326,348, 6,482,789, 6,677,289, 6,903,059, 6,660,711, 6,335,312, and WO 9918929. Yet other suitable branched surfactants include those described in WO9738956, WO9738957, and WO0102451.

In some aspects, the branched anionic surfactant comprises a branched modified alkylbenzene sulfonate (MLAS), as discussed in WO 99/05243, WO 99/05242, WO 99/05244, WO 99/05082, WO 99/05084, WO 99/05241, WO 99/07656, WO 00/23549, and WO 00/23548.

In some aspects, the branched anionic surfactant comprises a C12/13 alcohol-based surfactant comprising a methyl branch randomly distributed along the hydrophobe chain, e.g., Safol®, Marlipal® available from Sasol.

Further suitable branched anionic detersive surfactants include surfactants derived from alcohols branched in the 2-alkyl position, such as those sold under the trade names Isalchem®123, Isalchem®125, Isalchem®145, Isalchem®167, which are derived from the oxo process. Due to the oxo process, the branching is situated in the 2-alkyl position. These 2-alkyl branched alcohols are typically in the range of C11 to C14/C15 in length and comprise structural isomers that are all branched in the 2-alkyl position. These branched alcohols and surfactants are described in US20110033413.

Other suitable branched surfactants include those disclosed in U.S. Pat. No. 6,037,313 (P&G), WO9521233 (P&G), U.S. Pat. No. 3,480,556 (Atlantic Richfield), U.S. Pat. No. 6,683,224 (Cognis), US20030225304A1 (Kao), US2004236158A1 (R&H), U.S. Pat. No. 6,818,700 (Atofina), US2004154640 (Smith et al), EP1280746 (Shell), EP1025839 (L'Oreal), U.S. Pat. No. 6,765,119 (BASF), EP1080084 (Dow), U.S. Pat. No. 6,723,867 (Cognis), EP1401792A1 (Shell), EP1401797A2 (Degussa AG), US2004048766 (Raths et al), U.S. Pat. No. 6,596,675 (L'Oreal), EP1136471 (Kao), EP961765 (Albemarle), U.S. Pat. No. 6,580,009 (BASF), US2003105352 (Dado et al), U.S. Pat. No. 6,573,345 (Cryovac), DE10155520 (BASF), U.S. Pat. No. 6,534,691 (du Pont), U.S. Pat. No. 6,407,279 (ExxonMobil), U.S. Pat. No. 5,831,134 (Peroxid-Chemie), U.S. Pat. No. 5,811,617 (Amoco), U.S. Pat. No. 5,463,143 (Shell), U.S. Pat. No. 5,304,675 (Mobil), U.S. Pat. No. 5,227,544 (BASF), U.S. Pat. No. 5,446,213A (MITSUBISHI KASEI CORPORATION), EP1230200A2 (BASF), EP1159237B1 (BASF), US20040006250A1 (NONE), EP1230200B1 (BASF), WO2004014826A1 (SHELL), U.S. Pat. No. 6,703,535B2 (CHEVRON), EP1140741B1 (BASF), WO2003095402A1 (OXENO), U.S. Pat. No. 6,765,106B2 (SHELL), US20040167355A1 (NONE), U.S. Pat. No. 6,700,027B1 (CHEVRON), US20040242946A1 (NONE), WO2005037751A2 (SHELL), WO2005037752A1 (SHELL), U.S. Pat. No. 6,906,230B1 (BASF), WO2005037747A2 (SHELL) OIL COMPANY.

Additional suitable branched anionic detersive surfactants include surfactant derivatives of isoprenoid-based polybranched detergent alcohols, as described in US 2010/0137649. Isoprenoid-based surfactants and isoprenoid derivatives are also described in the book entitled "Comprehensive Natural Products Chemistry: Isoprenoids Including Carotenoids and Steroids (Vol. two)", Barton and Nakanishi, © 1999. Elsevier Science Ltd and are included in the structure E, and are hereby incorporated by reference.

Further suitable branched anionic detersive surfactants include those derived from anteiso- and iso-alcohols. Such surfactants are disclosed in WO2012009525. Additional suitable branched anionic detersive surfactants include those described in US Patent Application Nos. 2011/0171155A1 and 2011/0166370A1.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: $(R1)(R2)CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

The surfactant system disclosed herein may comprise any of the branched surfactants described above individually or the surfactant system may comprise a mixture of the branched surfactants described above. Furthermore, each of the branched surfactants described above may include a bio-based content. In some aspects, the branched surfactant has a bio-based content of at least about 50%, at least about 60%, at least about 70%, at least about 80%, at least about 90%, at least about 95%, at least about 97%, or about 100%.

Nonionic Surfactant

The concentrated composition of the present invention may comprise nonionic surfactant. Nonionic surfactant can be included to help lower the viscosity of the concentrate, as well as to provide cleaning benefits in the final product. Therefore, some organic acid, in its free acid form, may be replaced by nonionic surfactant. However, it is desirable that the ratio of free acid to salt remains within the range indicated by the present disclosure.

Preferred nonionic surfactants include ethoxylated and propoxylated nonionic surfactants. Preferred alkoxylated surfactants can be selected from the classes of the nonionic condensates of alkyl phenols, nonionic ethoxylated alcohols, nonionic ethoxylated/propoxylated fatty alcohols.

Highly preferred are nonionic alkoxylated alcohol surfactants, being the condensation products of aliphatic alcohols with from about 1 to about 75 moles of alkylene oxide, in particular to about 50, or from about 1 to about 15 moles, preferably to about 11 moles, particularly ethylene oxide and/or propylene oxide, are highly preferred nonionic surfactants. The alkyl chain of the aliphatic alcohol can either be straight or branched, primary or secondary, and generally contains from about 6 to about 22 carbon atoms. Particularly preferred are the condensation products of alcohols having an alkyl group containing from about 8 to about 20 carbon atoms with from about 2 to about 9 moles and in particular about 3 or about 5 moles, of ethylene oxide per mole of alcohol.

Polyhydroxy fatty acid amides are highly preferred nonionic surfactant comprised by the composition, in particular those having the structural formula $R^2CONR^1Z$ wherein: R1 is H, $C_{1-18}$, preferably $C_1$-$C_4$ hydrocarbyl, 2-hydroxy ethyl, 2-hydroxy propyl, ethoxy, propoxy, or a mixture thereof, preferable C1-C4 alkyl, more preferably $C_1$ or $C_2$ alkyl, most preferably $C_1$ alkyl (i.e., methyl); and $R_2$ is a $C_5$-$C_{31}$ hydrocarbyl, preferably straight-chain $C_5$-$C_{19}$ or $C_7$-C19 alkyl or alkenyl, more preferably straight-chain $C_9$-$C_{17}$ alkyl or alkenyl, most preferably straight-chain $C_{11}$-$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

In some aspects, the concentrated compositions comprise from about 0.01% to about to 20% by weight of the concentrated composition of nonionic surfactant. In some aspects, the concentrated composition is substantially free of nonionic surfactant, or comprises 0% nonionic surfactant.

Organic Solvent

The concentrated compositions of the present invention may comprise organic solvent. The use of an organic solvent may give the formulator the flexibility to decrease the amount of water and/or organic acid in the composition. In some aspects, the concentrated compositions comprise from about 0.05% to about 25%, or from about 0.1% to about 15%, or from about 1% to about 10% by weight of the composition organic solvent. In some aspects, the compositions are substantially free of organic solvent. As used herein, it is understood that an organic acid, which may be a carboxylic acid or a polycarboxylic acid, is not considered an organic solvent.

The organic solvent may be a short-chain alcohol. The short-chain alcohol may comprise a short-chain diol, which may comprise four carbons or fewer. In some aspects, the organic solvent is selected from propanediol, diethylene glycol (DEG), ethanol, or mixtures thereof. In some aspects, the organic solvent is propanediol. In some aspects, the organic solvent is selected from 1,2-propanediol, ethanol, glycerol, dipropylene glycol, methyl propanediol, or mixtures thereof. Other lower alcohols, such C1-C4 alkanolamines, for example monoethanolamine and/or triethanolamine, can also be used.

Hydrotropes

The concentrated compositions may comprise a hydrotrope. A hydrotrope is a compound that has the ability to increase the solubilities, preferably aqueous solubilities of certain slightly soluble organic compounds. In some aspects, the compositions comprise from about 0.01% to about 10%, or from about 0.25% to about 5% by weight of the composition of a hydrotrope.

The hydrotrope of the present invention can be selected from unsubstituted- and substituted-phenyl, benzyl, alkyl, or alkenyl carboxylic acid, or salts thereof; unsubstituted- and substituted-phenyl, benzyl, alkyl, or alkenyl sulfonic acid, or salts thereof; unsubstituted- and substituted-phenyl, benzyl, alkyl, or alkenyl sulfuric acid, or salts thereof; or mixtures thereof. Preferably the hydrotrope is selected from $C_1$-$C_4$ aryl sulfonate acid salts or mixtures thereof. In some aspects, the hydrotrope is selected from toluenesulfonates, cumenesulfonates, naphthalenesulfonates, xylenesulfonates, or mixtures thereof. More preferably said hydrotrope is a $C_1$-$C_4$ linear or branched alkyl aryl sulfonate acid salt, where the $C_1$-$C_4$ linear or branched alkyl group is in ortho-, meta-, or para-position at the aryl ring (in relation to the sulfonate acid salt group). Most preferably the hydrotrope is selected from ortho-, meta- or para-toluene sulfonic acid sodium salt, xylene sulfonic acid sodium salt, cumene sulfonic acid sodium salt, benzene sulfonic acid sodium salt, ethylbenzene sulfonic acid sodium salt, disodium 1,3 benzenedisulfonate, naphtalenesulfonate, or mixtures thereof.

Soil Suspension Polymers

The compositions may comprise from about 0.001% to about 0.5% by weight of the composition of soil suspension polymers. Soil suspension polymers include, without limitation, PEI ethoxylates, HMDA diquat ethoxylates, sulfonated derivatives, amphiphilic graft polymers, and hydrophobically modified anionic copolymers. Suitable polymers are described in, for example, U.S. Pat. Nos. 5,565,145, 6,579,839, 7,951,768, and 8,097,579, incorporated herein by reference.

Soil Release Polymers

The compositions may comprise from about 0.001% to about 0.5% by weight of the composition of soil release polymers. Soil release polymers include, without limitation, a PET alkoxylate short block copolymer, anionic derivative, or mixtures thereof.

Process for the Production of the Concentrated Surfactant Composition

The concentrated composition of the present disclosure is produced by combining sulfated surfactant acid precursor, neutralizing agent, and organic acid. The concentrated composition of the present invention may be made in either batch or continuous processes.

When using the batch process, the 3 ingredients may be combined in any order. However for efficiency it is preferred that the surfactant precursor and organic acid are combined in a first step, then sufficient neutralizing agent is added to substantially neutralize the surfactant and sufficient organic acid to achieve the desired ratio of organic acid to salt. Other ingredients may also then be added.

The concentrate may also be made in a continuous loop process, wherein all three ingredients are combined into the loop or, alternatively, two of the three ingredients are combined prior to entering the loop. Small amounts of surfactant/neutralizing agent/carboxylic acid product is then removed and the remainder continues in the loop reactor with a recirculation ratio of 1:10 (minimum). In certain cases, it is preferred to introduce the sulfated surfactant acid precursor and neutralizing agent in such a way to facilitate their complete mixing with each other immediately after entering the loop. Said product, produced within the loop, can then be directly used in the process to make the detergent product. Alternatively, said product can be directly added to a storage tank either to await later use in the process to make the detergent product or to await loading into an intermediate bulk container or other transport vessel that can be used to move said product to an alternate location that houses the process to make the detergent product.

Detergent Composition

A further aspect of the present invention relates to a detergent composition comprising the concentrated surfactant composition described above. The detergent composition may be in any form: liquid, gel, paste, tablet, unit dose, densified powder, or loose powder, but preferably liquid, and more preferably heavy duty liquid. In some aspects, the detergent composition is encapsulated in a water-soluble or water-dispersible pouch. The water-soluble film or pouch may comprise polyvinyl alcohol, polyvinyl acetate, or mixtures thereof. In some aspects, the unit dose form comprises at least two compartments, or at least three compartments. At least one compartment may be superimposed on another compartment.

In some aspects, the detergent composition comprises up to about 50%, or up to about 60%, or up to about 70%, or up to about 80%, by weight of the detergent product composition, of water. In some aspects, the detergent composition comprises from about 50% to about 90%, or from about 65% to about 80%, by weight of the detergent composition, of water. In some aspects, for example when the detergent composition is encapsulated in a water-soluble or water-dispersible pouch, the detergent product composition comprises less than about 35%, or less than about 30%, or less than about 20%, or less than about 15%, by weight of the detergent product composition, of water.

The concentrated surfactant composition may be combined with other detergent composition ingredients at any point in the manufacture of the detergent composition. Conventional methods of making may be used, include batch or continuous loop processes. However, it is preferred that the ingredients are added at an appropriate point so as not to greatly affect the viscosity of the product. In a further preferred aspect of the process of making the detergent composition, the composition is neutralized to an appropriate pH. In some aspects, the pH of a 10% solution of the detergent composition in distilled water at ambient temperature is in the range of from about 7 to about 9, or from about 7.5 to about 8.5, or from about 7.7 to about 8.3. In some aspects, the pH of a 10% solution of the detergent composition in distilled water at ambient temperature is in the range of from about 2 to about 7, or from about 3 to about 5.5, or from about 4 to about 5. The pH of the composition is measured using standard techniques and equipment, examples of which are discussed above.

Optional Detergent Adjunct Ingredients

The detergent composition may optionally comprise a detergent adjunct ingredient. Additionally, in some aspects, the concentrated surfactant composition may comprise detergent adjunct ingredients. Suitable detergent adjuncts are listed below but are intended to be non-limiting. Additionally, ingredients listed above, for example, nonionic surfactant, organic solvent, hydrotropes, and polymers, are also suitable detergent adjunct ingredients. As used herein, "by weight of the composition" refers to the weight either of the detergent product composition or of the concentrated surfactant composition.

Surfactants

The compositions of the present disclosure comprise sulfated surfactant as described above, but may additionally comprise further surfactants. Preferably, the composition comprises from about 1% to about 80%, or from about 5% to about 50%, by weight of the composition, of surfactant.

Further surfactants utilized can be selected from anionic, nonionic, zwitterionic, ampholytic, or cationic surfactants and mixtures thereof. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980, all incorporated herein by reference. Anionic and nonionic surfactants are preferred.

In a preferred embodiment, the composition of the present invention comprises an anionic sulphonate surfactant, more preferably a sodium, potassium, substituted ammonium or alkanolamine alkylbenzene sulfonate in which the alkyl group contains from about 9 to about 15 carbon atoms, in straight chain or branched chain configuration. Such preferred surfactants are described in U.S. Pat. Nos. 2,220,099 and 2,477,383. Especially valuable for inclusion herein are linear straight chain alkylbenzene sulfonates in which the average number of carbon atoms in the alkyl group is from about 11 to 13, abbreviated to $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{14}$ alcohol condensed with about 7 moles of ethylene oxide per mole of alcohol Amine oxides and/or amine ethoxylates may also be suitable nonionic surfactants.

Whitening Agent

The compositions of the present disclosure may comprise a whitening agent. The whitening agent preferably exhibits a hueing efficiency. Such agents have been found to exhibit good tinting efficiency during a laundry wash cycle without exhibiting excessive undesirable build up during laundering. Fluorescent whitening agents useful herein include those that are compatible with an acidic environment such as Tinopal CBS-X.

Fabric Care Benefit Agents

The compositions may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the composition, are suitably at levels of up to about 30% by weight of the composition, more typically from about 1% to about 20%, preferably from about 2% to about 10%.

Detersive Enzymes

The compositions may comprise detersive enzymes. Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compositions are from about 0.0001% to about 5%. When enzymes are present, they can be used at very low levels, e.g., from about 0.001% or lower, in certain embodiments of the disclosure, or they can be used in heavier-duty laundry detergent formulations in accordance with the disclosure at higher levels, e.g., about 0.1% and higher. In accordance with a preference of some consumers for "non-biological" detergents, the present disclosure includes both enzyme-containing and enzyme-free embodiments.

Deposition Aid

As used herein, "deposition aid" refers to any cationic polymer or combination of cationic polymers that significantly enhance the deposition of a fabric care benefit agent onto the fabric during laundering.

Preferably, the deposition aid is a cationic or amphoteric polymer. The amphoteric polymers of the present disclosure will also have a net cationic charge, i.e., the total cationic charges on these polymers will exceed the polymer's total anionic charge. Nonlimiting examples of deposition enhancing agents are cationic polysaccharides, chitosan and its derivatives and cationic synthetic polymers. Preferred cationic polysaccharides include cationic cellulose derivatives, cationic guar gum derivatives, chitosan and derivatives, and cationic starches.

Rheology Modifier

In some aspects, the composition comprises a rheology modifier. In some aspects, the rheology modifier is selected from the group consisting of non-polymeric crystalline, hydroxy-functional materials, polymeric rheology modifiers which impart shear thinning characteristics to the aqueous liquid matrix of the composition. Crystalline, hydroxy-functional materials are rheology modifiers which form thread-like structuring systems throughout the matrix of the composition upon in situ crystallization in the matrix. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis).

In some aspect, the rheology modifier is a polymeric rheology modifier. In some aspects, the rheology modifier is selected from polyacrylates, polymeric gums, other non-gum polysaccharides, and combinations of these polymeric materials. Preferred polymeric gum materials include pectine, alginate, arabinogalactan (gum Arabic), carrageenan, gellan gum, xanthan gum, guar gum and mixtures thereof.

Builder

The compositions of the present disclosure may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. In some aspects, the builder is a citrate builder, e.g., citric acid and soluble salts thereof.

Other preferred builders include ethylene diamine disuccinic acid and salts thereof (ethylene diamine disuccinates, EDDS); ethylene diamine tetraacetic acid and salts thereof (ethylene diamine tetraacetates, EDTA); diethylene triamine penta acetic acid and salts thereof (diethylene triamine penta acetates, DTPA); hydroxy ethylene diphosphonate (HEDP); aluminosilicates such as zeolite A, B, or MAP; fatty acids or salts, preferably sodium salts, thereof, preferably C12-C18 saturated and/or unsaturated fatty acids; and alkali metal or alkali earth metal carbonates or bicarbonates, preferably sodium carbonate.

In some aspects, the composition comprises from about 0.01% to about 10% by weight of the composition of builder. However, as used herein, the organic acid of the concentrated composition (e.g., citric acid) is not to be included when determining the percentage of builder present in the composition.

Bleaching System

Bleaching agents suitable herein include chlorine and oxygen bleaches, especially inorganic perhydrate salts such as sodium perborate mono-and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807).

Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition.

Bleach catalysts preferred for use herein include the manganese triazacyclononane and related complexes (U.S. Pat. Nos. 4,246,612, 5,227,084); Co, Cu, Mn and Fe bispyridylamine and related complexes (U.S. Pat. No. 5,114,611); and pentamine acetate cobalt(III) and related complexes(U.S. Pat. No. 4,810,410).

Perfume

Perfumes are preferably incorporated into the detergent compositions of the present disclosure. The perfumes may be prepared as a premix liquid or may be linked with a carrier material such as cyclodextrin.

In some aspects, the compositions disclosed herein may comprise a perfume delivery system. Suitable perfume delivery systems, methods of making certain perfume delivery systems, and the uses of such perfume delivery systems are disclosed in USPA 2007/0275866 A1. Such perfume delivery system may be a perfume microcapsule. The perfume microcapsule may comprise a core that comprises perfume and a shell, with the shell encapsulating the core. The shell may comprise a material selected from the group consisting of aminoplast copolymer, an acrylic, an acrylate, and mixtures thereof. The aminoplast copolymer may be melamine-formaldehyde, urea-formaldehyde, cross-linked melamine formaldehyde, or mixtures thereof. The perfume microcapsule's shell may be coated with one or more materials, such as a polymer, that aids in the deposition and/or retention of the perfume microcapsule on the site that is treated with the composition disclosed herein. The polymer may be a cationic polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, poly vinyl amine, copolymers of poly vinyl amine and N-vinyl formamide, and mixtures thereof. The perfume microcapsule may be friable and/or have a mean particle size of from about 10 microns to about 500 microns or from about 20 microns to about 200 microns. In some aspects, the composition comprises, based on total composition weight, from about 0.01% to about 80%, or from about 0.1% to about 50%, or from about 1.0% to about 25%, or from about 1.0% to about 10% of perfume microcapsules. Suitable capsules may be obtained from Appleton Papers Inc., of Appleton, Wis. USA. Formaldehyde scavengers may also be used in or with such perfume microcapsules.

Pearlescent Agent

The compositions of the present disclosure may comprise a pearlescent agent. The pearlescent agent may be organic or inorganic, and is preferably inorganic. The pearlescent agent can be selected from mica, TiO2 coated mica, bismuth oxychloride, or mixtures thereof.

Dyes

The compositions may comprise a dye to either provide a particular color to the composition itself (non-fabric substantive dyes) or to provide a hue to the fabric (hueing dyes). In one aspect, the compositions of the present invention comprise from about 0.0001% to about 0.01%, by weight of the composition, of a non-fabric substantive dye and/or a hueing dye. Examples of dyes useful herein include Basic Violet 3 (Cl 42555) and Basic Violet 4 (Cl 42600), both commercially available from Standard Dyes (High Point, N.C.), and Liquitint Violet 200 from Milliken Company.

Other Adjuncts

Examples of other suitable adjunct materials include, but are not limited to, alkoxylated benzoic acids or salts thereof, such as trimethoxy benzoic acid or a salt thereof (TMBA); enzyme stabilizing systems; scavenging agents including fixing agents for anionic dyes, complexing agents for anionic surfactants, or mixtures thereof; optical brighteners or fluorescers; dispersants; suds suppressors; colorants; color speckles; colored beads, spheres or extrudates; preservatives; clay softening agents; or mixtures thereof. Suitable laundry adjuncts are described, for example, in U.S. application Ser. No. 13/623,128, incorporated herein by reference.

Viscosity

In some aspects, the present compositions have viscosities of less than about 250 Pa*s, or less than about 50 Pa*s, or less than about 25 Pa*s, when measured at 30° C. at 1 $s^{-1}$. In some aspects, the present compositions have viscosities of from about 0.01 Pa*s to about 500 Pa*s, or from about 1 Pa*s to about 250 Pa*s, or from about 10 Pa*s to about 50 Pa*s, or from about 10 Pa*s to about 25 Pa*s, when measured at 30° C. at 1 $s^{-1}$. In some aspects, the present compositions have viscosities of less than about 50 Pa*s, or less than about 5 Pa*s, or less than about 2 Pa*s, when measured at 30° C. at 25 $s^{-1}$.

The detergent compositions herein may be in the form of paste, gel, pourable gels, non-pourable gels, or heavy-duty liquids. The form may include thick liquids. A thick liquid may be a Newtonian fluid, which does not change its viscosity with the change in flow condition, such as honey or syrup. This type of thick liquid is very difficult and messy to dispense; however, when the composition has a viscosity of 2 Pa*s or less, a Newtonian fluid may be preferred. A different type of thick liquid is shear-thinning, i.e. it is thick under low shear (e.g., at rest) and thin at high flow rates. The rheology of shear-thinning thick liquids is described in more detail in the literature, see for example WO 04\027010A1 Unilever.

In these definitions and unless specifically indicated to the contrary, all stated viscosities are those measured at a shear rate of 1 $s^{-1}$ and at a temperature of 30° C. Viscosity herein can be measured with any suitable viscosity-measuring instrument, e.g., a Carrimed CSL2 Rheometer at a shear rate of 1 $sec^{-1}$.

Chemical and Physical Stability

In some aspects, the present compositions are chemically and/or physically stable.

Chemical stability can be measured via the amount of surfactant active that is lost over time, when exposed to conditions that are relevant to typical supply chains. Analytical methods, such as hyamine titration, can be used for this and are well known to those familiar in the art. Alternatively, the by-products of the surfactant hydrolysis mechanism include both alcohol (ethoxylate) and a sulfate ion. Measuring the gain in either of these materials, using analytical techniques that are known to those familiar in the art, can be an equally effective method of measuring chemical stability of the concentrated composition. In some aspects, the average rate at which sulfate level increases in the present compositions, when stored at 55° C., is less than 1000 ppm per week, preferably less than 750 ppm per week, more preferably less than 500 ppm per week, and most preferably less than 250 ppm per week.

Physical stability can be measured via static observation of the concentrated samples over time or, alternatively, with accelerated techniques via mechanical separation processes including, for example, centrifugation. Failures in physical stability most often manifest in multiple phases of material that do not remain mixed. These multiple phases could exist, for example, as a solid/liquid phase equilibrium, as a liquid/liquid phase equilibrium due, for example, to immiscibility, as multiple liquid crystal phases in equilibrium, and combinations thereof. In the present compositions, liquid/liquid phase coexistences (liquid crystal or otherwise) when stored statically in typical supply chain conditions are desired to be present in ratios that are no greater than 3:1 of the primary phase to the secondary phase. In addition, the present compositions are preferred to be substantially free of solid material when stored statically in typical supply chain conditions. In some aspects, the present compositions are present in a single phase.

Method of Use

The present disclosure provides a method for treating a surface, for example, fabric, with the compositions (either the concentrated surfactant composition or the detergent composition) disclosed herein. In some aspects, the method comprises the steps of optionally washing and/or rinsing the surface, contacting the surface with the presently disclosed composition, then optionally washing and/or rinsing the surface. Following the treatment of the surface with the composition, the surface may optionally be dried. The surface may be contacted with the composition in neat form or in dilute form; in some aspects, the composition may be mixed with wash water. The method for treating a surface may be performed manually, such as by hand washing, or in an automated fashion, such as by a machine, e.g., a laundry washing machine.

EXAMPLES

The present examples are representative of the present disclosure and are not intended to be limiting.

Chemical stability is determined by the relative change in sulfate ion ("sulfate") concentration, before and after storage. Neat, undiluted samples of the product are prepared for storage by filling two thirds of a 250 mL wide-mouthed plastic jar (available from Nalgene) and sealing tightly with a polypropylene plastic lid. The filled, sealed jars are stored at 55° C. for 6 weeks, in darkness without agitation. Sulfate concentrations are measured in ppm (parts per million) of sulfate ion, determined before and after storage, according to the following method.

Sulfate ion concentration is assayed using high-performance anion-exchange liquid chromatography. The stationary phase used for separation is a commercially available anion exchange column, based on latex prepared with a glycidoxystyrene monomer quaternized with methlydiethanolamine. Detection of sulfate is achieved using a suppressed conductivity detector. Quantification is achieved using an external linear calibration curve prepared by assaying standards of known concentrations at 5, 10, 20, 40, 80, and 160 ppm of sulfate. Specificity for sulfate is confirmed by using sulfate-spiked control samples of the product being analyzed. HPLC-grade de-ionised water, filtered and degassed, is used as diluent for standards and samples. Product samples to be analyzed are diluted as necessary to fit within the calibration curve concentrations, and filtered through a 0.45 μm pore size nylon syringe filter, after mixing thoroughly with the diluent water for 30 mins.

A suitable set of assay conditions are: the Dionex ICS-5000 Ion Chromatography Instrument System (Thermo Scientific, Bannockburn, Ill.), with the Dionex IonPac AS11-HC 4 mm×25 mm column (Thermo Scientific, Bannockburn, Ill.), operating with the column temperature at 30° C., and sulfate eluted isocratically using an aqueous sodium hydroxide solution mobile phase of 30 mM [OH—], at a flow rate of 1.0 mL/min. The sample injection volume is 10 μL, the suppressor current is 100 mA, and the run time is 15 minutes.

If any modifications to these assay conditions are required (e.g., the use of gradient elution in order to spread out overlapping peaks in a particular product sample), then the modified conditions must achieve specificity for sulfate within the product matrix. This specificity is determined and demonstrated via a sulfate spiking experiment under the modified conditions.

TABLE 1

Table 1 relates to sample formulations of the concentrated compositions of the present invention. Values given are as percentage by mass of the composition. Examples A and B are comparative examples.

| | 1 | 2 | 3 | 4 | 5 | 6 | A (comp.) | B (comp.) |
|---|---|---|---|---|---|---|---|---|
| Active acid-form AES surfactant (HC24-AE3S, MW = 404) | 55.67 | 60.03 | 65.01 | 55.67 | 55.58 | 55.58 | 66.39 | 67.77 |
| Lactic Acid (via 88% w/w in water) | 18.25 | 18.25 | 14.00 | 22.00 | 18.25 | 18.25 | 0.00 | 0.00 |
| Sodium Hydroxide (via 50% w/w in water) | 10.99 | 8.74 | 8.61 | 8.86 | 8.29 | 6.33 | 7.31 | 0.00 |
| Water (via stock raw material feeds and neat water added) | 13.48 | 11.23 | 10.52 | 11.86 | 16.17 | 18.13 | 24.25 | 0.00 |
| DTPK Fatty Acid | 0.00 | 0.00 | 0.00 | 0.00 | 0.00 | 0.00 | 0.00 | 20.00 |
| MEA | 0.00 | 0.00 | 0.00 | 0.00 | 0.00 | 0.00 | 0.00 | 11.98 |
| Minors | 1.61 | 1.75 | 1.86 | 1.61 | 1.71 | 1.71 | 2.05 | 0.25 |

TABLE 2

Table 2 relates to physical properties and composition stability (both chemical and physical) of the concentrated compositions of the present invention.

| | | 7 | 8 | 9 | 10 | 11 | 12 |
|---|---|---|---|---|---|---|---|
| Active neutralized AES surfactant (NaC24-AE3S, MW = 426) | mass % | 58.5 | 63.1 | 68.3 | 58.5 | 58.5 | 58.5 |
| Target Lactic Acid | mass % | 18.25 | 18.25 | 14.0 | 22.0 | 18.25 | 18.25 |
| Target Lactic:Lactate | mole ratio | 1:2 | 2:1 | 2:1 | 2:1 | 2:1 | 10:1 |
| Resulting pH (10% solution) | — | 4.23 | 3.50 | 3.53 | 3.51 | 3.51 | 2.78 |
| Viscosity (Pa * s) @ 1 $s^{-1}$ | 30° C. | 27.8 | 28.0 | 35.6 | 1.2 | N/A | N/A |
| | 40° C. | 22.9 | 22.7 | 29.9 | 0.6 | N/A | 154.4 |
| Viscosity (Pa * s) @ 25 $s^{-1}$ | 30° C. | 3.7 | 4.4 | 4.0 | 1.2 | N/A | N/A |
| | 40° C. | 2.9 | 3.3 | 3.1 | 0.6 | N/A | 15.0 |
| Sulfate Gain after 12 weeks (55° C.) | ppm | 1372 | 1103 | 1026 | 606 | 949 | 2768 |
| Physically stable? | | Yes | Yes | Yes | Yes | No | No |

TABLE 3

Table 3 relates to a detergent composition that may be formulated with a concentrated composition according to the present invention.

| Component | % Active by Wt. |
|---|---|
| Sodium alkyl sulfate (C12-13 EO3) | 18.00 |
| High active HSAS | 15.60 |
| Liner Alkylbenzyne Sulfonate (C11.8) | 3.00 |
| Alkyl Ethoxylate C24 EO9 | 2.40 |
| C12-18 Fatty Acid | 2.50 |
| Lactic acid | 6.50 |
| Brightener * | 0.37 |
| Polymer (ethoxylated polyethyleneimine) ** | 1.75 |
| Calcium Formate | 0.16 |
| DTPA (diethylene triamine penta acetate) | 0.30 |
| NaOH | 3.65 |
| Ethanol | 3.00 |
| 1,2-Propanediol | 11.67 |
| Sodium Formate | 0.65 |

TABLE 3-continued

Table 3 relates to a detergent composition that may be formulated with a concentrated composition according to the present invention.

| Component | % Active by Wt. |
|---|---|
| Borax premix | 4.00 |
| Perfume | 0.85 |
| PR-109 (54.5 mg/g) | 2.08 |
| Natalase (29.26 mg/g) | 0.40 |
| Water | To 100% |

* disodium 4,4'-bis {[4-anilino-6-morpholino-s-triazin-2-yl]-amino}-2,2'-stilbenedisulfonate, available from Ciba Specialty Chemicals (Basel, Switzerland) as BR15
** PEI600 E20, available from BASF The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any disclosure disclosed or claimed herein or that it alone, or in any combination with any other reference or references, teaches, suggests or discloses any such disclosure. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A concentrated surfactant composition comprising:

a. from about 50% to about 80% by weight substantially neutralized anionic sulfated surfactant, wherein the anionic sulfated surfactant is alkyl ethoxylated sulfate (AES), the AES comprising an alkyl group that contains from about 12 to about 18 carbon atoms, and the AES comprising a polyethyoxylate chain containing from about 1 to about 4 ethoxylate moieties;

b. from about 12% to about 22% of a water-soluble organic acid, wherein the organic acid is lactic acid; and c. a neutralizing agent, wherein the neutralizing agent is selected from alkali metal hydroxides, alkali earth metal hydroxides, ammonium hydroxides, and mixtures thereof;

wherein the composition has a pH of from about 3 to about 5 when measured in an aqueous 10% solution of the composition, and wherein the surfactant composition has a viscosity of less than about 50 Pa*s measured at 1 $s^{-1}$ and at 30° C. and wherein the lactic acid is present in its free acid form and its salt in a molar ratio from about 5:1 to about 1:5.

2. The concentrated surfactant composition according to claim 1, wherein the surfactant composition comprises from about 55% to about 70% by weight of the surfactant composition sulfated surfactant.

3. The concentrated surfactant composition according to claim 1, wherein the surfactant composition further comprises from about 0.1% to about 15% by weight of the surfactant composition of an organic solvent.

4. The concentrated surfactant composition according to claim 1, wherein the surfactant composition contains no nonionic surfactant that has been deliberately added to the composition other than, if any, as an impurity in another material that was deliberately added.

5. The concentrated surfactant composition according to claim 1, wherein the surfactant composition further comprises from about 10% to about 45% by weight of the composition of water.

6. The concentrated surfactant composition according to claim 1, wherein the surfactant composition has a reserve alkalinity of from about 0.5 to about 7.5 equivalent grams NaOH per 100 grams of concentrated composition, wherein the reserve alkalinity is determined by titrating a 1% (w/v) solution of surfactant composition with hydrochloric acid to pH 3.0 at 21° C.

7. A detergent composition comprising the concentrated composition of claim 1, and further comprising a detergent adjunct.

8. A method for preparing a detergent composition, comprising the following steps:

a. providing the concentrated surfactant composition of claim 1; and b. mixing the surfactant composition with water, detergent adjuncts, or mixtures thereof to form a detergent composition.

9. The concentrated surfactant composition according to claim 1, the composition comprising from about 15% to about 25% water.

10. A concentrated surfactant composition according to claim 1, wherein if the composition comprises any fatty acid, the fatty acid is present only as an impurity in another material that is deliberately added to the composition.

* * * * *